United States Patent [19]

Kawashima

[11] Patent Number: 4,946,399

[45] Date of Patent: Aug. 7, 1990

[54] DOUBLE-LOCKING DEVICE FOR CONNECTOR TERMINALS AND METHOD OF PREPARING THE LOCKING DEVICE

[75] Inventor: Toshiharu Kawashima, Shizuoka, Japan

[73] Assignee: Yazaki Corporation, Tokyo, Japan

[21] Appl. No.: 254,630

[22] Filed: Oct. 7, 1988

[30] Foreign Application Priority Data

Oct. 9, 1987 [JP] Japan ..... 62-153989

[51] Int. Cl.[5] ..... H01R 13/514

[52] U.S. Cl. ..... 439/752; 439/603; 29/842

[58] Field of Search ..... 439/595, 603, 747, 752; 29/842

[56] References Cited

U.S. PATENT DOCUMENTS

| | | | |
|---|---|---|---|
| 3,487,355 | 12/1969 | Cairns | 339/176 |
| 3,501,736 | 3/1970 | Plyler et al. | 339/217 |
| 4,583,805 | 4/1986 | Mantlik | 339/61 |
| 4,660,915 | 2/1987 | Mantlik | 339/61 |
| 4,705,337 | 11/1987 | Maeda | 439/595 |
| 4,711,508 | 12/1987 | Sueyoshi | 439/595 |
| 4,787,864 | 11/1988 | Hunt et al. | 439/595 |

FOREIGN PATENT DOCUMENTS

| | | |
|---|---|---|
| 54-28625 | 9/1976 | Japan . |
| 55-92284 | 6/1980 | Japan . |
| 2024537 | 1/1980 | United Kingdom . |
| 2081526B | 2/1982 | United Kingdom . |

*Primary Examiner*—Eugene F. Desmond

*Attorney, Agent, or Firm*—Armstrong, Nikaido, Marmelstein, Kubovcik & Murray

[57] ABSTRACT

A primary locking means consisting of an engagement provided in a wall of the terminal holding chamber and retractably protruding into the chamber and another engagement of the contact terminal engageable with the engagement in the terminal holing chamber wall, a double-locking device includes a locking pin multiple having a horizontal and top pin supporting plate and a plurality of locking pins downwardly extending from the supporting plate, each of the locking pin having an engagement engageable with an engagement in the contact terminal near the primary locking means to protect the contact terminals from slipping-off. The locking pin multiple is made as a long moulding having a great many of the locking pins and the mouldings is cut to make an appropriate length of a locking pin multiple corresponding to the kind of connector housing.

10 Claims, 4 Drawing Sheets

DOUBLE-LOCKING DEVICE FOR CONNECTOR TERMINALS AND METHOD OF PREPARING THE LOCKING DEVICE

BACKGROUND OF THE INVENTION

The present invention relates to improvements in a double-locking device for connector terminals and method of preparing the locking device.

Terminals in a connector are usuallly secured therewithin by means of struck-out pieces integrally formed in the terminals, with the struck-out pieces being engaged with the bottom wall of terminal holding chambers in an insulated housing. Alternatively, flexible engaging arms integrally formed from the ceiling of the holding chambers may be brought into engagement with shoulder portions or holes in electric contact portions of the terminals.

However, the struck-out pieces and engaging arms are so small in size that they are subject to damage as male and female connectors are attached and detached repetitively, thus resulting in frequent slip offs of the terminals or poor contact thereby.

Japanese Utility Model Publication No. 55-92284 discloses a connector as shown in FIG. 6 wherein a recess c is provided in a peripheral wall of the insulated housing a so as to communicate with terminal holding chambers b. Into the recess c is inserted a terminal fixing member f having projections each of which is complementary with the terminal holding chamber b in cross section and having a terminal retaining concave e at its lower end. The concave e holds and retains contact terminal d into which an electrical wire w is connected. The terminal fixing member f is fixed to the connector housing a by means of locking g, g', which consist of projections g' provided within the cavity c and on both side walls of the insulated housing a and openings g in the right and left end walls of the terminal fixing member f.

On the other hand, Japanese Utility Model Publication No. 54-28625 discloses a connector as shown in FIG. 7*a* and 7*b* wherein an insulated housing a' has a throughhole c' into which an insertion pin h is inserted so that it can be engaged at its side surface with a shoulder j or the like provided with an electrical contact portion i of contact terminal d'.

In the conventional connector as shown in FIGS. 6 and 7*a* and 7*b*, in addition to a locking means provided between the contact terminal and the corresponding terminal holding chamber, insertion members or spacers such as terminal fixing member f or insertion pin h as shown in the drawings are formed separately from the housing and contact terminal. However, after the terminals, are inserted, it often happens that the insertion of pins is inadvertently ommited. Furthermore, the number of parts of the connector increases, and laborious work is required for controlling the inventory.

It is therefore desired from the stand point of assembling operation and the control of inventory to provide a connector that can be handled as one piece part with insertion pins for double-locking of the terminals that is tentatively locked to the insulated housing, and that is capable of accomplishing main locking after the terminals are inserted.

SUMMARY OF THE INVENTION

The object of the present invention is to provide a double-locking device for connector terminals that meets such requirement, the device being adapted to be used for various types of connectors.

DETAILED DESCRIPTION OF THE EMBODIMENTS

Figure 1:
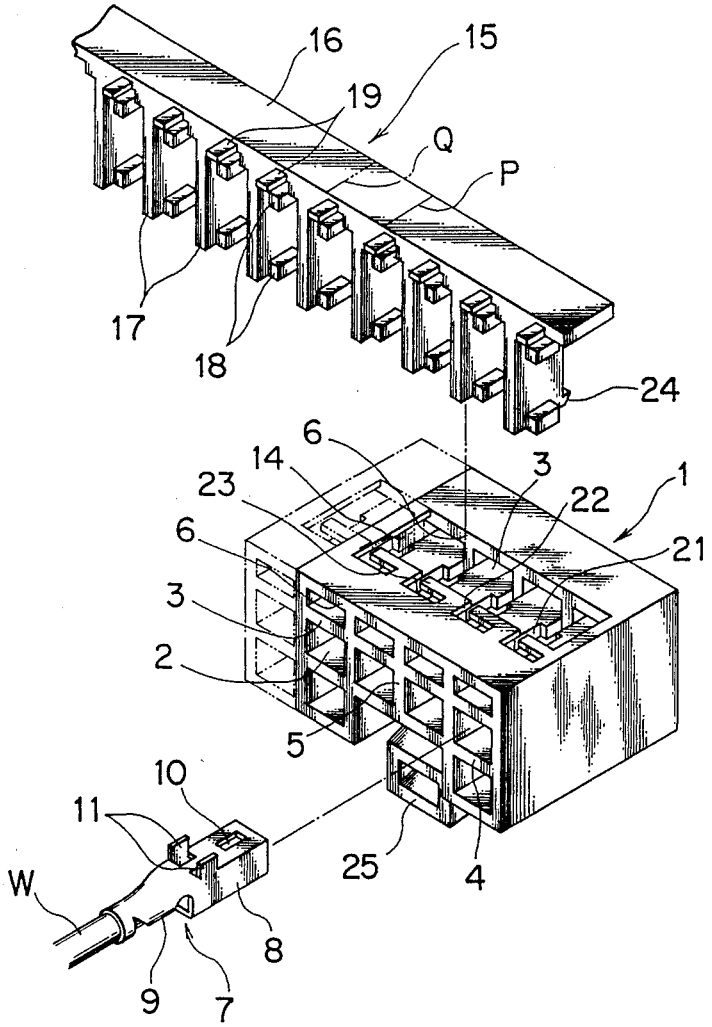
FIG. 1 is a perspective view which illustrates a connector having a double-locking device according to the present invention in a disassembled manner.

In FIGS. 1 through 5, a connector having a double-locking device according to the present invention comprises an insulated housing 1 of a rectangular shape having two upper and lower rows or stages of terminal holding chambers 2 and electrical terminals 7. The upper stage consists of four terminal holding chambers 2. The chambers 2 have two upper and two lower walls 3, 4 and two side partition walls 5. The insulated housing 1 has a top wall 6 arranged in parallel to and above the upper wall 3 of the terminal holding chambers 2.

The electrical terminal 7 includes a contact portion 8 of substantially square or rectangular section and a wire connecting portion 9 of substantially circular section which is connected with an electrical wire w.

The contact portion 8 of the connector terminal 7 has an opening 10 in the upper wall near the forward end, and two secondary locking projections 11 cut and bent up from the upper wall 12 of the contact portion 8 near the opening 10 as a unitary structure.

The insulated housing 1 is provided in the upper wall 3 of the terminal holding chamber 2 with a tongue 13 having a portion retractably protruding into the chamber 2 and accordingly engageable with the opening 10 in the electrical terminal 7. The tongue 13 and the opening 10 forms a primary locking device.

The insulated housing 1 is provided in its top wall 6 at a distance from the rear end with an opening or cut-out portion 14 of elongated rectangular shape extending in a direction perpendicular to that of the terminal holding chambers 2.

The connector according to this invention comprises a secondary locking device including a locking pin multiple 15 having an upper and horizontally extending pin supporting plate 16. The plate 16 supports a plurality of secondary locking pins 17 having the same width and thickness as that of the plate 16 and depending or extending downwardly therefrom. Each pin 17 has four protrusions 18 on both sides and in the upper and lower positions of the pin 17. The pin supporting plate 16 has projections 19 at the rear side to lock the locking pin multiple 15 in the connector housing 1 in a secondary locking position for terminals. The locking pin multiple 15 is manufactured as a very long molding including a long pin supporting plate 16 having a great number of locking pins 17 extending downwardly from the lower side of the supporting plate 16 and spaced at an equal distance between two adjacent ones which corresponds to that between both side partition walls 20 of the terminal holding chambers 2. So the pins 17 may be positioned respectively in the cut-out portion 14 of the corresponding vertical partitional walls 5. Pin multiple locking projections 19 are also arranged at the same distance as mentioned above the elongated pin multiples 15 are cut at different predetermined lengths from the molding according to several types of connector housings 1, for example, to accommodate a different number of terminal holding chambers 2 in the upper stage at the time of assembling the wire terminals in the connector housing. The insulated connector housing 1 may have four terminal holding chambers 2 on the upper stage as shown in a solid line or five chambers including a portion as shown in a two-dotted and one dashed line in FIG. 1. For the former four chambers housing, a locking pin multiple having three locking pins obtained by cutting the pin multiple moldings on the line P, is used and for the latter five chambers, the one cut on the line Q is usable.

The cut-out portion or recess 14 of elongaged rectangular shape in the top wall 6 has a bottom wall which corresponds to the upper wall 3 of the upper stage of the terminal holding chambers 2. The bottom wall of the cut-out portion 14 is formed with openings 21 extending along with the side partition walls 5 of the terminal holding chambers 2 and the partition walls 5 are also cut-out at the portion placed under the openings 21 in the bottom wall 3 of the cut-out portion 14 (the upper wall 3 of the terminal holding chambers 2) and further extend on both sides of the partition wall 5 so as to allow the protrusions 18 in the locking pins 17 to pass therethrough. The lower wall 4 of the terminal holding chamber 2 is also provided with the same openings 21 vertically aligned with those in the bottom wall 3 of the cut-out portion 14 so as to allow the lower protrusions 18 in the locking pins 17 to pass therethrough and protrude into the lower stage of terminal holding chambers 2.

The top wall 6 of the connector housing 1, on the periphery defining the cut-out portion 14, is provided with L-shaped cut-away portions 22 leaving deflectable catches 23 which cooperate with the pin multiple locking projections 19 to lock the locking pin multiple 15 in a fixed terminal locking position.

Figure 3:
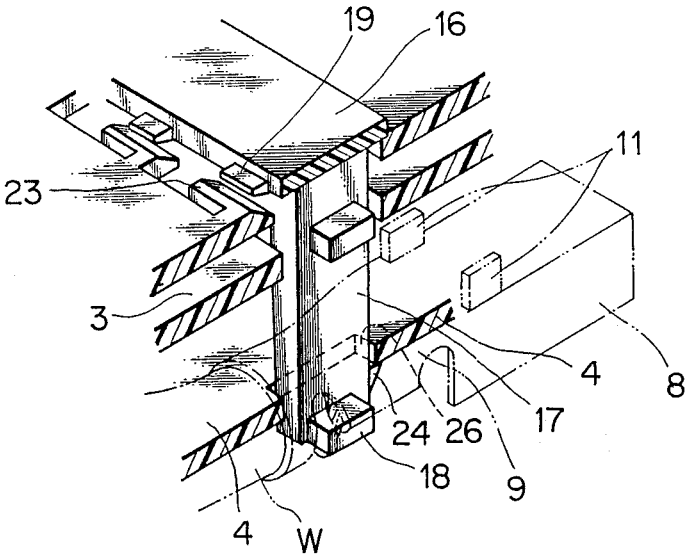
FIG. 3 is a cut-away perspective view showing major portions of FIG. 2.
Figure 5:
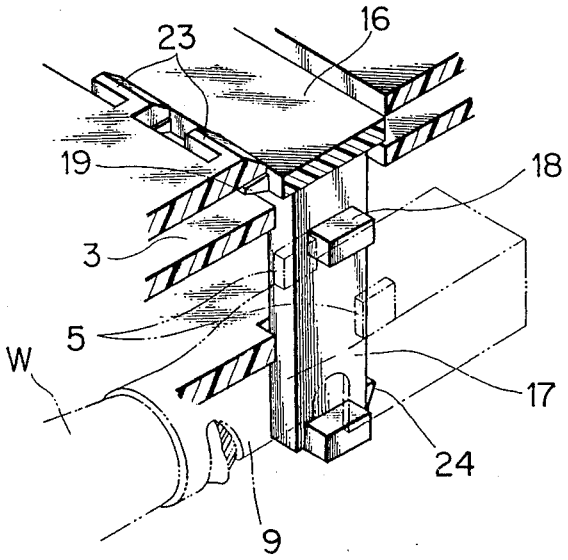
FIG. 5 is a cut-away perspective view showing major portions of FIG. 4.
Figure 7A:
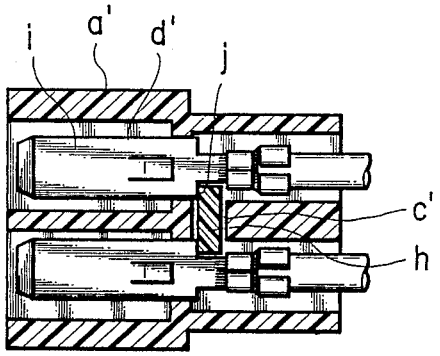
FIGS. 7*a* and 7*b* are respectively a horizontal and vertical sectional view of another type of conventional electrical connector as shown in the assembled state.
Figure 7B:
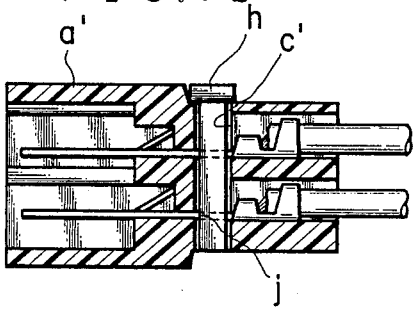
Figure 6:
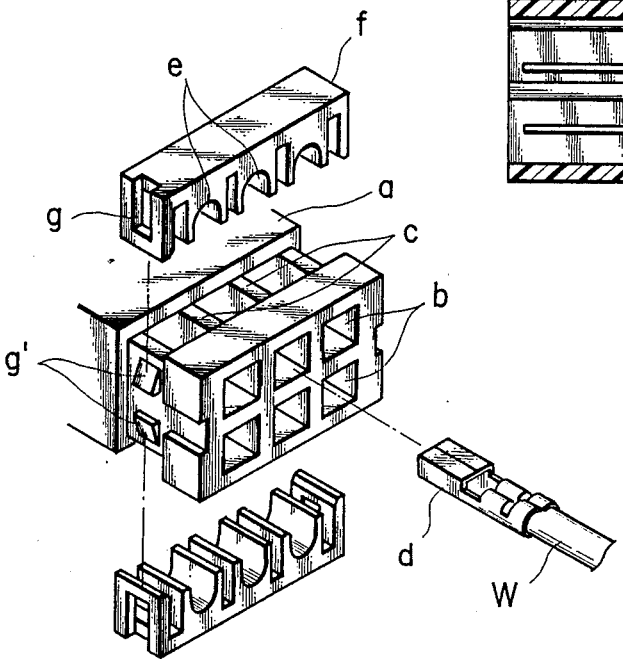
FIG. 6 is a perspective view of disassembled parts in one type of conventional electrical connector.

In FIGS. 3 and 5, a plurality of the contact terminals 7 are supposed to be inserted into a generally two-stage housing structure but only a lower stage terminal 7 is illustrated because the omission of the upper stage terminal 10 enables the inner arrangement to be shown clearly. However, the operation according to the present invention is described on the basis of the upper stage terminals 7 hereinafter. When the secondary locking pins 17 are positioned in a provisional or waiting position in which the secondary locking protrusion 18 in the locking pin 17 are positioned in a plane aligned with the upper wall 3 of the terminal holding chambers 2 and the pin multiple locking projections 19 are supported on the resilient locking catches 23, a provisional locking claw 24 is engaged with a lower and forward edge of the opening 7 of the lower wall 4 of the terminal holding chambers 2. When the secondary locking pins 17 are brought into the final locking position due to engagement of said pin multiple locking projections 19 with the lower surface of the catches 23, the protrusions 18 in the locking pins 17 protrude into the terminal holding chambers 2 and engages with the secondary locking projections 11 in the contact portion 8 of the electrical terminal 7 so that the terminals 7 are prevented from rearward movement.

In the aforementioned construction, the connector having a device according to this invention is constructed in the form of a male connector with six poles, the forewardmost wall of the insulated housing 1 is provided locking arms 25 for connection with the female connector (not shown), and six terminal holding chambers 2 arranged in upper and lower two stages in parallel accommodate female-type terminals 7 having electrical contact portions 8 of square section for receiving tabs of the counterparts. The flexible engaging tongue 13 protrudes from the upper wall 3 of the terminal holding chambers 2 as a unitary structure and is engaged with the opening 10 formed in the upper wall of the terminal 7 near the secondary locking projections 11.

In the foregoing was described the case of the male connector for retaining the female-type terminals therein. The present invention, however, can also be adapted in the same manner even to the case of the female connector for retaining the male-type terminals therein. Further, either the catches 23 or the pin multiple locking projections 19 may have flexibility, and the provisional locking claws 24 may be formed as small self-locking means.

Figure 2:
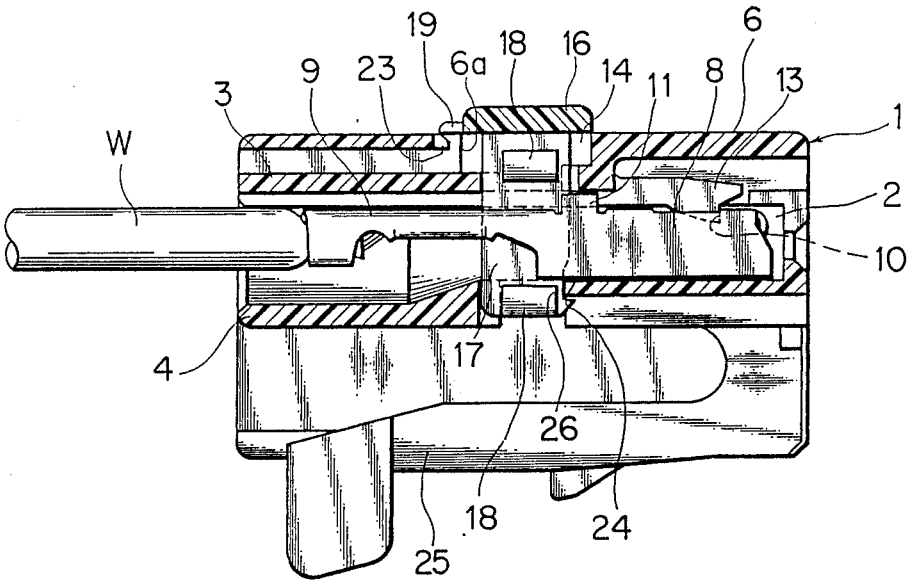
FIG. 2 is a sectional view illustrating the state where the insertion pins of the connector of FIG. 1 are tentatively locked.
Figure 4:
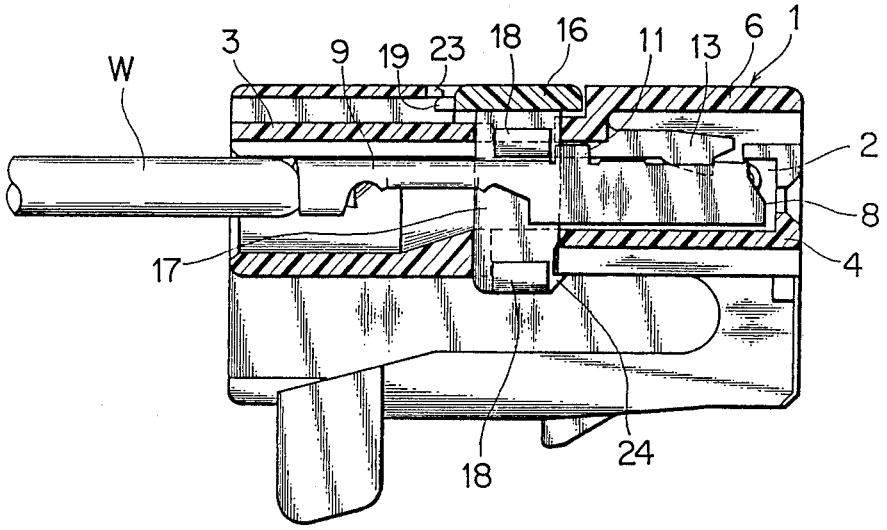
FIG. 4 is a sectional view illustrating the state where the insertion pins of the connector are fully locked.

The secondary locking pins 17 according to the present invention are inserted into the cut-out portion 14 and openings 21 as shown in FIGS. 2 to 5, whereby the pin multiple locking projections 19 come into contact with the catches 23 formed by L-shaped cut-away 22 to slightly deflect the catches 23 downwards while the provisional locking claw 24 comes into engagement with the edges 26 of openings 21, that is edges 26 of a lower wall 4 of the terminal holding chambers 2 in FIGS. 2 and 4, such that the secondary locking pins 17 are provisionally locked.

When the secondary locking pins 17 are located at the provisional locking position as described above, the protrusions 18 are positioned away from the interior of each terminal holding chambers 2 enabling the terminals 7 to be freely inserted or removed.

Then the terminals 7 are completely inserted and are primarily engaged by the primary locking means consisting of the tongues 13 and openings 10 of the terminals 7. Thereafter, the secondary locking pins 17 are pushed again as shown in FIGS. 4 and 5, whereby the pin multiple locking projections 19 in turn push the catches 23 to snap over the same and enter into the space between said catches 23 and the upper wall 3 of the terminal holding chambers 2 so that the secondary locking pins 17 are locked.

In this locking position, the locking protrusions 18 take the descending position to protrude into the terminal holding chambers 2, and are located rearwardly of the locking projections 11 of the terminals 7 to engage therewith. Therefore, the terminals 7 are prevented from moving rearwardly, i.e., prevented from slipping off from the housing 1 in cooperation with the abovementioned primary locking device 13 and 10 to realize a two-step locking. Here, the locking projectios 11 need not be cut out upward in the terminal 7, but the locking protrusions 18 may be brought into engagement with the shoulder of the electric contact portion 8 or with the rear edge of wire connecting portion 9 of the terminals 7.

Using the connector having a device according to the present invention as described in the foregoing, the secondary locking pins 17 are provisionally locked to the insulated housing 1 under the condition where the terminals 7 can be inserted into or removed from the terminal holding chambers 2. Therefore, the connector can be handled as a one-piece part, the secondary locking pins 17 can be used by cutting long chain polymer moldings at a suitable position that meets the requirements of a connector housing 1 having a predetermined number of holding chambers of the connector, thereby obviating the need of manufacturing the secondary locking pins 1 in a variety of kinds.

I claim:

1. A double-locking connector comprising an insulated housing having a cut-out portion and at least one stage of a plurality of terminal holding chambers arranged in parallel and receiving and holding contact terminals inserted at one end, a primary locking means including a flexible arm provided in a wall of each terminal holding chamber and retractably protruding into the chamber and an opening in each contact terminal engageable with the arm in the terminal holding chamber wall, and a secondary locking means carried by said insulated housing in said cut-out portion and including a locking pin multiple having a horizontal pin supporting plate and a plurality of locking pins depending from the supporting plate, each of the locking pins having a protrusion movable into a terminal holding chamber, each of said contact terminals having a projection formed thereon, and said locking pin multiple is movable after said primary locking means is engaged to engage said protrusions with said contact terminal projections to protect the contact terminals from disengaging from the primary locking means when the locking pin protrusions are moved into the terminal chambers to engage the protrusions with said projections.

2. A double-locking connector as claimed in claim 1 wherein the projections formed on the contact terminals are upstanding projections formed by cutting and bending the contact terminals rearward of and adjacent to said openings in said contact terminals.

3. A double-locking connector as claimed in claim 2 wherein adjacent terminals holding chambers of said insulated housing are separated by vertical partition walls having the same thickness as a thickness of the locking pins, and said locking pins are received in recesses in said partition walls.

4. A double-locking connector as claimed in claim 3 wherein the locking pins can take two positions as they are inserted into the pin receiving recesses, one of said positions being a position in which the protrusions on the locking pins are positioned in a plane aligned with an upper wall of the terminal holding chambers and a second position in which the protrusions extend into the terminal holding chambers.

5. A double-locking connector as claimed in claim 4 wherein the pin supporting plate has locking projections provided at least at one side, deflectable catches are provided in a top wall of the housing at a periphery of said cut-out portion and said locking projections are adapted to be engage with said deflectable catches, whereby when the pin supporting plate is pushed down into the cut-out portion the locking projections urge the catches to deflect and pass under the catches to lock the locking pin multiple in the cut-out portion with said locking pins in said recesses.

6. A double-locking connector as claimed in claim 5 wherein when the locking projections contact an upper surface of the deflectable catches said protrusions formed on the pins are positioned in a plane aligned with an upper wall of the terminal holding chambers and in a cut-out portion of the wall, and when said pin supporting plate in pushed down, the locking projections pass the deflectable catches and are disposed under the catches and the locking protrusions on the pins are positioned to protrude into the terminal holding chambers to engage said projections on the contact terminals.

7. A double-locking connector according to any one of claims 1 to 6 wherein said insulated housing has at least one stage of a plurality of terminal holding chambers above another stage, the locking pin multiple has a plurality of locking pins, and the difference between the number of locking pins and the number of terminal holding chambers in the uppermost stage is not greater than one.

8. A double-locking connector according to any one of claims 4 to 6, wherein the locking pins have a provisional engaging claw at a lower and forward end so that when the locking pin is positioned in said one position each provisional engaging claw is engaged with a lower edge of a lower wall of a terminal holding chamber opened by the pin receiving recess portion.

9. A double-locking connector according to any one of claims 5 or 6, wherein said insulating housing has at least one stage of a plurality of terminal holding chambers above another stage, the number of the locking projections provided to the pin supporting plate is equal to the number of the terminal holding chambers in the uppermost stage and the locking projections are provided at locations intermediate adjacent ones of said locking pins.

10. A method of preparing a double-locking device for connector terminals comprising the steps of: preparing a locking pin multiple including a horizontal and top pin supporting plate and a plurality of locking pins depending from the supporting plate, each of the locking pins having an engagement engageable with an engagement of a contact terminal when set in position in a connector housing, the pin supporting plate having on at least one side thereof a plurality of locking pin multiple locking projections, the locking pins and the locking pin multiple locking projections being arranged on the supporting plate at a predetermined distance determined according to a spaced arrangement of a plurality of contact terminals, said locking pin multiple being made as a long molding having a plurality of locking pins and locking pin multiple locking projections, and cutting the molding to provide at least one length of a locking pin multiple corresponding to a length and number of an arrangement of contact terminals in a connector housing into which the locking pin multiple is to be inserted.

* * * * *